United States Patent [19]

Spurgeon

[11] 3,965,662

[45] June 29, 1976

[54] FALSE TWISTING DEVICE

[76] Inventor: Richard C. Spurgeon, R.D. No. 2, Lansdale, Pa. 19446

[22] Filed: Oct. 16, 1974

[21] Appl. No.: 515,331

[52] U.S. Cl. ..... 57/77.33; 57/77.4

[51] Int. Cl.[2] ..... D02G 1/08

[58] Field of Search ..... 57/77.33, 77.4, 77.42, 57/106

[56] References Cited

UNITED STATES PATENTS

| | | | |
|---|---|---|---|
| 3,287,890 | 11/1966 | McIntosh et al. | 57/77.4 |
| 3,782,091 | 1/1974 | Spurgeon | 57/77.4 X |
| 3,828,541 | 8/1974 | Raschle | 57/77.4 X |
| 3,854,276 | 12/1974 | Marzoli | 57/77.4 |

*Primary Examiner*—Richard C. Queisser
*Assistant Examiner*—Charles Gorenstein
*Attorney, Agent, or Firm*—Louis V. Schiavo

[57] ABSTRACT

Untextured yarn is drawn from a producer's package, threaded through apparatus comprising a tension leveling device, an electric heater and a false twist device and, having been textured thereby, is wound on yarn take-up means. The false twist device comprises a staggered arrangement of friction discs and a plurality of hold down arms. The yarn passes over the rims of the several discs in contact therewith and is twisted as the discs rotate in the same direction at the same rate of speed. The arms function to effectively limit movement of the yarn back and forth circumferentially of the discs, as a consequence of which the yarn is twisted in place or very nearly in place.

4 Claims, 5 Drawing Figures

FALSE TWISTING DEVICE

BACKGROUND OF THE INVENTION

1. Field of the Invention

The present invention relates to the texturing of yarn by false twisting.

2. Description of the Prior Art

An end of thermoplastic yarn consisting of a few filaments, i.e., one, two, three or four, is not entirely satisfactory for being frictionally clutched by the friction disc or discs of a false twist device because while the individual filaments may be round in transverse section, the end of yarn is not round in transverse section. For example, as a two filament yarn is twisted, first one filament, then both and then the other are presented to the rim of the friction disc in repeating cycles for being clutched. Since part of the effectiveness of the friction disc for twisting the yarn is dependent upon whether the rim of the friction disc clutches only one or both filaments, it follows that the effectiveness of the friction disc for twisting the yarn fluctuates. As a consequence, the segment of yarn passing over the rim of the friction disc vibrates or oscillates, i.e., moves perceptively back and forth from side to side circumferentially of the friction disc. The movement may be observed with the naked eye as a shadowy area. This is one of the principal causes of the uneven texturing which results from false twisting effected by the friction disc or discs of a false twist device.

It is common knowledge that if a bow is drawn across a string which is drawn taut, the string is set to vibrating. In like manner, since the yarn passing over the rim of a friction disc in contact therewith for being twisted is tensioned, it is set to vibrating when the friction disc is actuated. The vibration is in the fundamental mode, i.e., the two points at which the yarn is restrained against vibration, respectively on opposite sides of the disc, are the only nodal points, and the center is the only antinode. For the fundamental mode of vibration the yarn segment forms one loop, which has a length equal to a half wave. The resulting vibration or oscillation, superimposed upon the movement noted hereinbefore, contributes materially to the uneven texturing which results from false twisting effected by the friction disc or discs of a false twist device.

SUMMARY OF THE INVENTION

The principal object of the present invention is to provide improved apparatus and method for texturing continuous filament thermoplastic yarn by false twisting.

Another object of the present invention is to provide such apparatus and method whereby vibration or oscillation of the yarn segment passing over the rim of a friction disc to be twisted is reduced to a minimum.

Still another object of the present invention is to provide such apparatus wherein the means for reducing vibration of the yarn is in part self-adjusting so that overall adjustment of said means for the purpose intended may be effected with a minimum expenditure of time and effort.

BRIEF DESCRIPTION OF THE DRAWINGS

FIG. 4 illustrates how the yarn segment traversing the false twist device vibrates until the false twist device is adjusted to eliminate the vibration. For the sake of clarity, the yarn is shown by a single line representation.

DESCRIPTION OF THE PREFERRED EMBODIMENT

Figure 1:
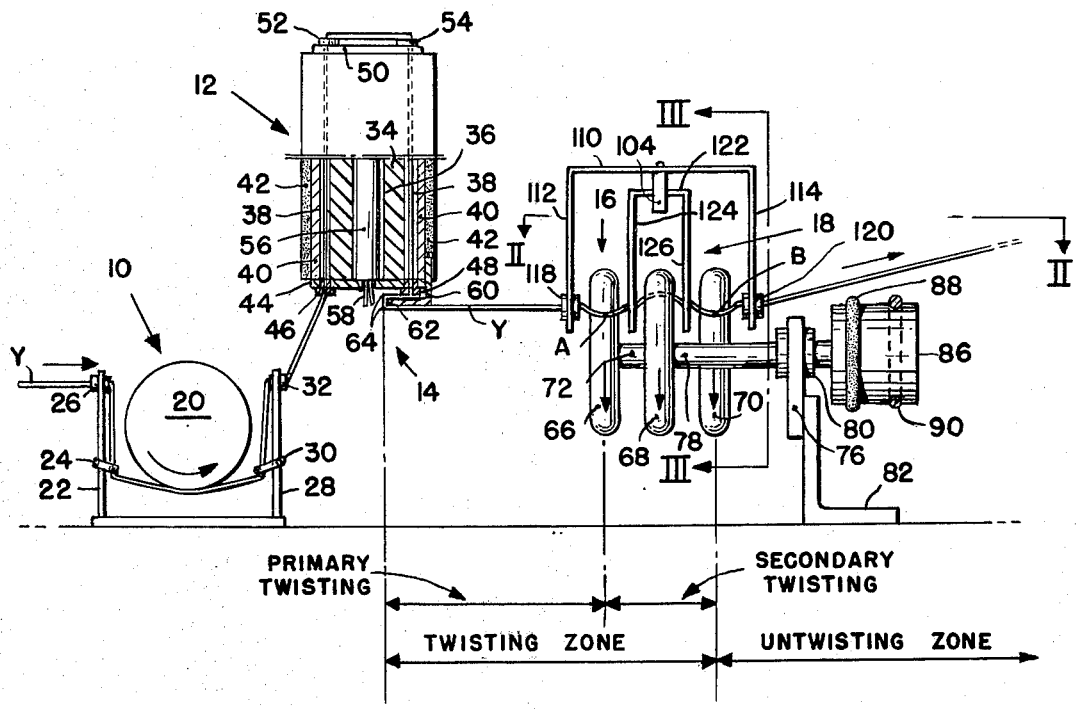
FIG. 1 is an elevation diagrammatically showing apparatus which may be used to practice the method of the invention.
Figure 2:
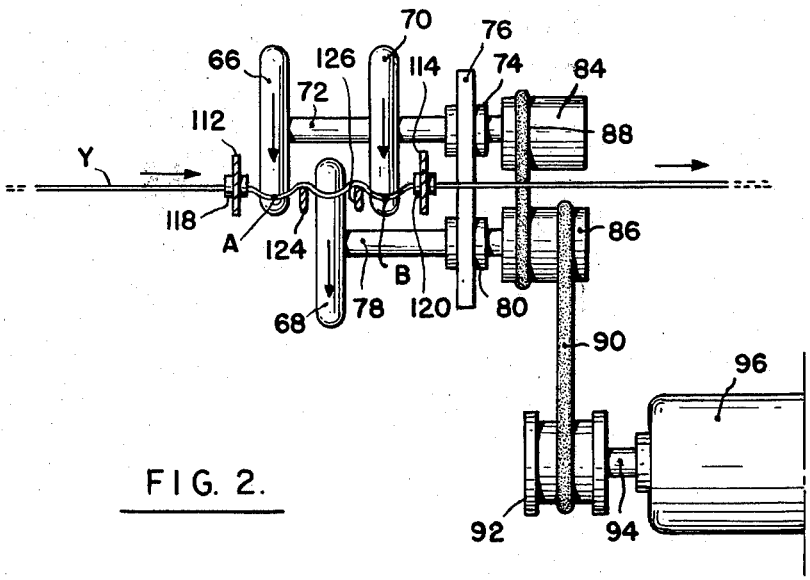
FIG. 2 is a fragmentary section on lines II—II in FIG. 1.

Referring particularly to FIGS. 1 and 2, the apparatus shown includes a tension leveling device 10, an electric heater 12, a twist stop device 14, a false twist device 16, and a check device 18.

The tension leveling device 10 includes a roller 20. To the left of the roller 20 is a standard 22 embraced by a ring 24 and provided with an eyelet 26 at the head thereof, and to the right of the roller 20 is a second standard 28 embraced by a ring 30 and provided with an eyelet 32 at the head thereof. Reference may be had to my U.S. Pat. No. 3,323,753, issued June 6, 1967, for the essential features of the tension leveling device and for the principles of its operation. While the tension leveling device just described is preferred, it will be understood that other devices, such as Casablanca positive feed type devices may be used instead.

Referring particularly to FIG. 1, the heater 12 comprises a main body 34 with a longitudinally extending central opening 36 and two longitudinally extending grooves 38 respectively disposed on oppositely facing sides thereof. The groove 38 on each side of the main body 34 is covered by a plate 40, and extending about the main body 34 and the plates 40 is a jacket 42 of insulating material. At the bottom of the heater is a plate 44 which carries an eyelet 46 on the inlet side thereof aligned with the associated groove 38 and an eyelet 48 on the outlet side thereof aligned with the associated groove 38. At the top of the heater is a plate 50 which carries an eyelet 52 on the inlet side thereof aligned with the associated groove 38 and an eyelet 54 on the outlet side thereof aligned with the associated groove 38. The central opening 36 accommodates a heating coil 56 energized by means of wire leads 58 connected to a suitable source of electric current (not shown). Reference may be had to my U.S. Pat. No. 3,626,682, issued Dec. 14, 1971, for a more detailed disclosure of the heater 12. While the heater 12 is a double pass heater, it will be understood that a double pass heater is not essential. Another type may be used, such, for example, as a heater provided with a long curved plate over which the yarn passes.

Adjustably fixed to the base of the heater by means not shown and depending therefrom is a plate 60 to which is affixed the twist stop device 14. The device 14 is in the form of a plate, which may be of any desired thickness. However, the longitudinally extending marginal portion 62 thereof preferably is provided with square edges, designated 64. The false twist device 16 and the check device 18 are combined in one unitary structure, now to be described.

The false twist device comprises a friction disc 66, and the check device 18 comprises a pair of friction discs 68 and 70. The friction discs preferably are made of synthetic rubber, metal, ceramics, wood, synthetic resins, or combinations of the foregoing. The friction discs 66 and 70 are mounted upon a shaft 72 journalled in a sleeve bearing 74 carried by a plate 76, while the friction disc 68 is mounted upon a shaft 78 journalled in a sleeve bearing 80 carried by the plate 76. The plate 76 is mounted upon a supporting bracket 82. The shafts 72 and 78 respectively mount pulleys 84 and 86, which are interconnected by a belt 88, and the pulley 86 is connected by a belt 90 to a pulley 92. The pulley 92 is mounted upon the shaft 94 of an electric motor 96. Yarn guide means is provided for holding the yarn to the rims of the several friction discs.

The yarn guide means may comprise a frame, generally designated 98, including a base 100 mounting aa standard 102, which in turn mounts an arm 104 pivotally connected by a suitable element 106 to the upper end portion of the standard 102. The effective length of the arm 104 may be varied by projecting the element 106 through a selected hole 108. A first member 110 of inverted U-shape provided with laterally spaced arms 112 and 114 is connected by a suitable element 116 to the free end portion of the arm 104. The arms 112 and 114 depend from the arm 104 and are disposed respectively on the upstream side of the friction disc 66 and the downstream side of the friction disc 70 for mounting a pair of eyelets 118 and 120. A second member 122 of inverted U-shape provided with laterally spaced hold down arms 124 and 126 extends through a free end portion of the arm 104 and is thereby pivotally mounted thereon. The member 122 is adjustably fixed in position by a suitable element 128. The arms 124 and 126 of the member 122 depend from the arm 104 and are disposed respectively between the friction discs 66 and 68 and between the friction discs 68 and 70. Referring particularly to FIG. 2, preferably at least the longitudinally extending narrow edges of the arms 124 and 126 that engage the yarn are rounded in transverse section.

An end of untextured multifilament yarn, designated Y, is drawn from a yarn package (not shown) and threaded through the eyelet 26, passed downwardly along the standard 22 and threaded through the ring 24. Then it is passed under the roller 20 in contact therewith, threaded through the ring 30, passed upwardly along the standard 28 and threaded through the eyelet 32. Next, the yarn end is looped through the heater 12, being passed upwardly through the eyelet 46, the groove 38 and the eyelet 52 on the inlet side of the heater, then downwardly through the eyelet 54, groove 38 and eyelet 48 on the outlet side of the heater. When the yarn end issues from the eyelet 48, it is turned sharply to one side and trained along the upper surface of the stop plate 14, about the edges 64 thereof, fully in contact therewith, and along the undersurface of the stop plate 14 toward the false twist device 16. It will be noted that the portion of the yarn path extending about the stop plate 14 is substantially in the form of a square loop. At the combined false twist device 16 and check device 18, the yarn end is passed through the eyelet 118, over the rim of the disc 66, under the arm 124 of the member 122, over the rim of the disc 68, under the arm 126 of the member 122, over the rim of the disc 70 and through the eyelet 120. From the eyelet 120, the yarn end goes to a yarn take-up means.

In the operation of the apparatus, the roller 20 turns in yarn advancing direction at a speed which exceeds the linear speed of the yarn end. Tension in the yarn is induced by resistance to movement of the yarn over the edges 64 of the stop plate 14. The yarn between the tension leveling device 10 and the yarn take-up means will be predetermined in length for a desired yarn tension. When said length increases, the rings 24 and 30 are lowered, removing some of the yarn from engagement with the roller 20 and increasing slippage between the roller 20 and the yarn end. Thus the amount of yarn passing under the roller 20 is reduced and the yarn between the tension leveling device and the yarn take-up means is restored to its initial length. When said length decreases, the rings 24 and 30 are raised, causing a greater length of yarn to engage the roller 20 and decreasing slippage between the roller 20 and the yarn end. Thus the amount of yarn passing under the roller 20 is increased and the length of yarn between the tension leveling device and the yarn take-up means is restored to its initial length.

Referring to the drawings, the yarn Y is trained over the outer peripheral working surfaces or rims of the friction discs 66, 68 and 70. The discs turn in the same direction at the same rate, making approximately 3,450 r.p.m. As a consequence, the yarn end is twisted about its central axis, as will be understood by those skilled in the art. The twist extends upstream to the stop device or plate 14. The twist zone may be of any selected short length, but preferably is in the order of seven inches long. It will be evident that if the stop plate 14 is to function for the purpose intended, i.e., for restricting the twist in the yarn end to the downstream side of the plate 14, yarn tension must be such that the yarn end is drawn firmly about the plate 14. Any significant drop in yarn tension would render the plate 14 ineffective and cause the twist to extend or reach upstream into the heater 12. The tension leveler 10, exercising tight control over yarn tension, effectively functions to prevent any such occurrence by maintaining yarn tension uniform.

The point at which twisting ends and untwisting tends to begin, designated A, is on the crest of the rim of friction disc 66, which applies the primary twist effort. However, the yarn segment between the friction discs 66 and 70 cannot untwist because the tendency to do so is cancelled out by the action of the discs 68 and 70, which apply a secondary twist effort that operates to immediately put the twist back in again. The yarn segment downstream from the friction disc 70 not only has a tendency to untwist, but it does in fact do so, thereby being somewhat elongated and relaxed. This tendency for the yarn to elongate and relax in response to untwisting tends to reach upstream past the point B, on the crest of the rim of the friction disc 70, but it is prevented from doing so by twisting of the yarn segment extending between the friction discs 66 and 70 as aforesaid, and also by the friction generated by linear movement of the yarn over the rims of the friction discs 68 and 70 in contact therewith. Reference may be had to my U.S. Letters Pat. No. 3,777,469, issued Dec. 11, 1973, for further details respecting the mode of operation whereby the terminal at which twisting ends and untwisting begins becomes fixed at point B.

I have found that ordinarily when a yarn is subjected to false twisting by means of friction discs, the yarn segment passing over the rims of the discs vibrates, and that the vibration contributes significantly to non-uniformity of the twist in the finished product.

Figure 3:
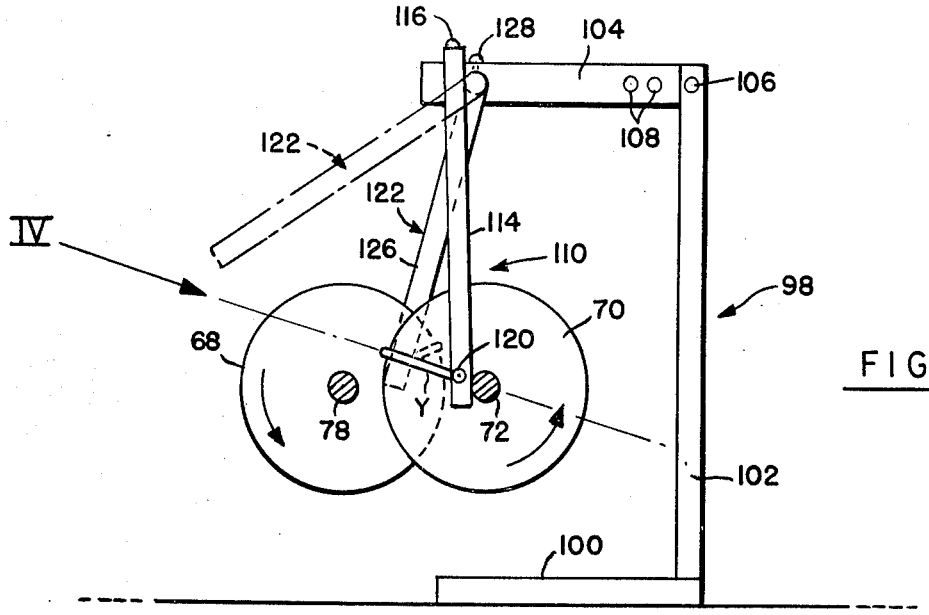
FIG. 3 is a section on lines III—III in FIG. 1.
Figure 5:
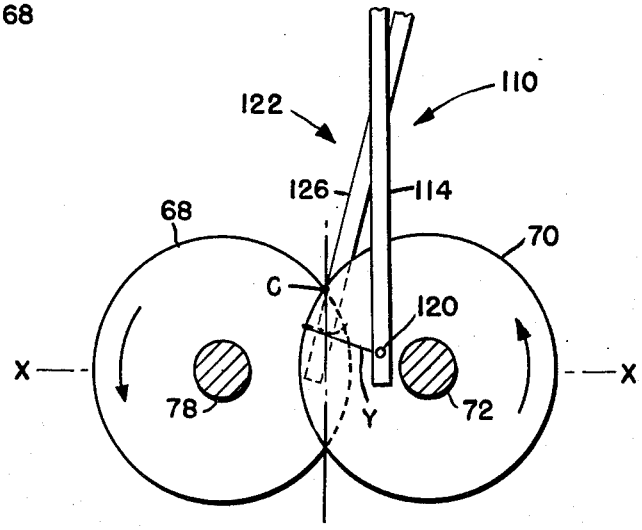
FIG. 5 is an enlarged view somewhat similar to the corresponding area shown in FIG. 3. In this view, too, for the sake of clarity, the yarn is shown by a single line representation.

Accordingly, when the yarn is to be threaded through the combined false twist device 16 and check device 18, the member 104 is suitably adjusted in effective length and angularly about the element 106, and the member 122 is positioned with its arms 124 and 126 altogether clear of the friction discs 66, 68 and 70, for example, as shown in phantom in FIG. 3. In addition, the member 110 is positioned with the eyelets 118 and 120 located quite close to the shaft 72, above a plane, designated X—X, containing the axes of the shafts 72 and 78, as shown in FIGS. 3 and 5. With the member 122 in the inoperative position thereof shown in phantom in FIG. 3, the yarn is passed through the eyelets 118 and 120. When the slack in the yarn is taken up, the yarn extends in one big loop between the eyelets. In other words, the yarn is first passed through the eyelet 118 and turned outwardly away from the shaft 72, then trained over the friction discs 66, 68 and 70 in contact with all three friction discs, and finally turned inwardly (as at a point designated C, FIG. 5) toward the shaft 72 before being passed through the eyelet 120.

Figure 4:
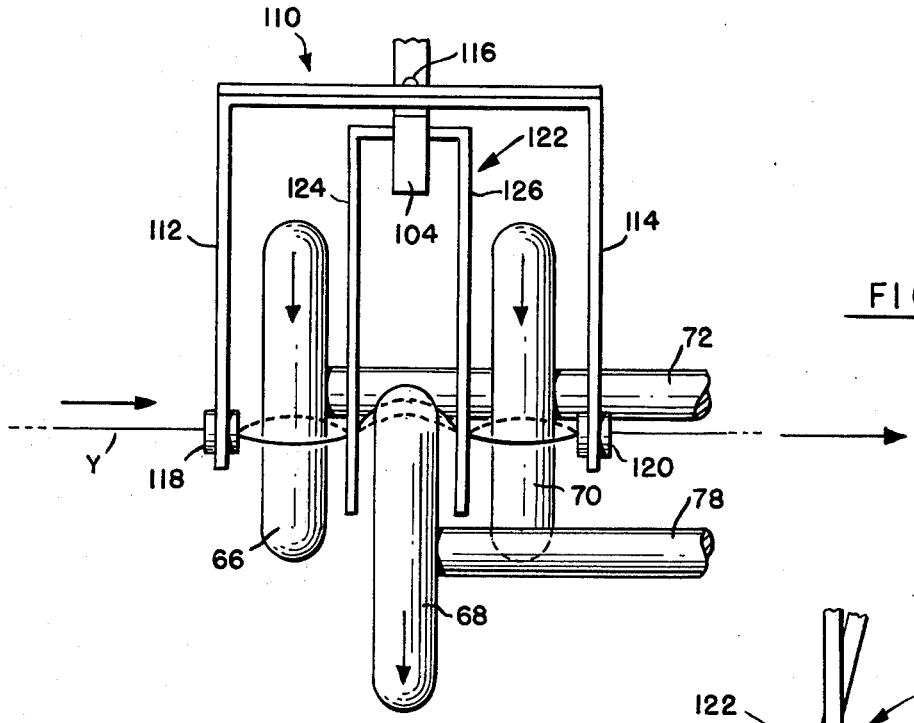
FIG. 4 is an enlarged fragmentary view looking downwardly and to the rear of the false twist device, at an angle of approximately 30°, as indicated by the arrow IV in FIG. 3.

After the end of yarn starts through the apparatus, the element 128 is turned out a bit to release the member 122, which is then turned counterclockwise, as viewed in FIG. 3, until its arms 124 and 126 engage the yarn. Continued turning of the member 122 counterclockwise causes the arms 124 and 126 to press the yarn downwardly and rearwardly. As the angular distance through which the arms 124 and 126 are moved increases, the yarn progressively works its way downwardly on the arms 124 and 126, around the friction discs 66 and 70 in a counterclockwise direction and around the rim of the friction disc 68 in a clockwise direction, as indicated in FIGS. 3 and 5. While the arms 124 and 126 are being turned counterclockwise to press the yarn downwardly and rearwardly, the yarn vibrates between the full and broken line positions thereof shown in FIG. 4, and the vibrations may be observed with the naked eye as a shadowy area. As the arms 124 and 126 are brought down more and more heavily upon the yarn, the shadowy area becomes smaller and smaller, indicating less and less vibration, until it disappears altogether and the yarn is seen to turn in place about its central axis. When the yarn is seen to turn in place, the element 128 is turned in again to secure the member 122. Elimination of the vibration is advantageous because it helps keep the length of yarn between the tension leveler and the yarn take-up means constant.

It will be noted that the means for reducing vibration of the yarn is in part self-adjusting. The operator turns the member 122 counterclockwise so that its arms 124 and 126 are inclined as desired. However, the yarn automatically "hunts" the locations at which it will cross the arms 124 and 126. For each different inclination of the member 122, the yarn engages the arms 124 and 126 at different locations along the lengths of the arms 124 and 126. In view of the foregoing, the means aforesaid for reducing the vibration of the yarn to a minimum may be adjusted for the purpose intended with a minimum expenditure of time and effort.

As noted hereinbefore, the length of the arm 104 may be varied by projecting the element 106 through a selected hole 108 in the arm 104. In addition, the arm 104 may be swung upwardly and downwardly about the element 106 to raise or lower the members 110 and 122 and the eyelets 118 and 120 respectively carried by the arms 112 and 114 of the member 110. The member 110 may be swung about the element 116 to facilitate positioning of the arms 112 and 114 and the eyelets 118 and 120 respectively carried thereby.

When the member 122 is disposed with its arms 124 and 126 clear of the yarn, the segment of yarn passing over the friction discs, i.e., between the eyelets 118 and 120, is set to vibrating by the several friction discs in the manner of a plurality of bows drawn across a string. The vibration is in the fundamental mode, as a consequence of which the amplitude of the wave generated by the vibrating yarn segment is the maximum possible for the given yarn tension and length of loop. The vibration may be seen as a shadowy area. When the member 122 is disposed with its arms 124 and 126 bearing on the yarn, the yarn segment is set to vibrating in three loops, instead of one, thus reducing the amplitude of the wave generated, and correspondingly reducing the shadowy area observed.

While, in accordance with the provisions of the patent statutes, I have illustrated and described the best embodiment for the practice of my invention now known to me, it will be apparent to those skilled in the art that changes may be made without departing from the scope of the invention as set forth in the appended claims.

What is claimed is:

1. In apparatus for false twisting yarn, the combination comprising a. a plurality of friction discs alternate and intervening ones of which respectively are revolvable about laterally spaced generally parallel axes, said discs being disposed with said alternate discs to the rear of said intervening discs, and with the rims of said alternate and intervening discs overlapping, b. means for turning said discs in yarn twisting direction, c. means through which said yarn may be threaded for guidance and coaction with said discs to form of the length of yarn spanning said guide means a single loop extending over said discs, and d. a plurality of members each having a section with a substantially straight elongated edge, said members being adjustably fixed in position and operable for bringing said edges into engagement with the loop of yarn extending over said discs and pressing the same downwardly and rearwardly between each pair of adjacent discs a selected distance, said yarn being free, in response to adjustment of said members to assume a position along said edges whereat vibration of said yarn circumferentially of said discs is substantially eliminated and said yarn is twisted in place on the rims of said discs.

2. The combination according to claim 1 wherein the members operable for pressing the loop of yarn extending over the friction discs downwardly and rearwardly between each pair of adjacent discs are selectively shiftable between a string-up position in which they stand clear of said discs and an operating position in which each of said members is disposed between an adjacent pair of said discs for passage of said yarn thereunder in engagement with the substantially straight edge thereof.

3. The combination according to claim 2 wherein the selectively shiftable members are elongated and the substantially straight edges under which the yarn passes are rounded in transverse section.

4. The combination according to claim 2 wherein the alternate and intervening discs of the false twist device total three in number, the selectively shiftable members are the elongated arms of a member of inverted U-shape, and said arms depend from means pivotally mounting said U-shaped member for selectively positioning said arms angularly about an axis generally parallel to the axes of said discs.

* * * * *